United States Patent [19]

Honkawa

[11] 4,428,041

[45] Jan. 24, 1984

[54] DEVICE FOR PREVENTING IRREGULAR SUPPLYING OF PRINTING SHEETS FOR PRINTING MACHINE

[75] Inventor: Yoshinori Honkawa, Fuchu, Japan

[73] Assignee: Ryobi Ltd., Hiroshima, Japan

[21] Appl. No.: 260,615

[22] Filed: May 5, 1981

[30] Foreign Application Priority Data

May 9, 1980 [JP] Japan ..... 55-62015

[51] Int. Cl.[3] ..... G06F 15/46

[52] U.S. Cl. ..... 364/183; 364/184; 364/900; 271/263; 340/675

[58] Field of Search ..... 364/184, 183; 271/263; 364/900 MS File; 209/522, 536, 576; 340/674, 675

[56] References Cited

U.S. PATENT DOCUMENTS

| | | | |
|---|---|---|---|
| 3,778,051 | 12/1973 | Allen et al. | 271/263 |
| 3,779,731 | 12/1973 | Pollock et al. | 364/184 |
| 3,793,512 | 2/1974 | Lorenzen | 364/184 |
| 4,151,410 | 4/1979 | McMillan et al. | 271/263 |
| 4,349,269 | 9/1982 | Okada | 271/263 |

OTHER PUBLICATIONS

'Double Document Detect System', by W. A. Boothroyd, IBM Tech. Discl. Bull., vol. 19, No. 12, May 1977.

*Primary Examiner*—Jerry Smith
*Assistant Examiner*—William G. Niessen
*Attorney, Agent, or Firm*—Sughrue, Mion, Zinn, Macpeak and Seas

[57] ABSTRACT

A device for preventing irregular supplying of printing sheets in a printing machine in which the supply of two or more printing sheets stuck together is positively prevented even if the quantity of light passing through a printing sheet is changed such as by a change in an original plate. A detection circuit detects the quantity of light passing through the printing sheets. The output of the detection circuit is coupled to a memory circuit which is activated to store a value representing a quantity of light corresponding to a single printing sheet. This operation is performed in advance before a printing operation is started. A control circuit operated by the memory circuit controls the printing machine operation such that the sheet supplying operation is suspended when the quantity of light detected by the detection circuit is less than the value stored in the memory circuit.

5 Claims, 3 Drawing Figures

DEVICE FOR PREVENTING IRREGULAR SUPPLYING OF PRINTING SHEETS FOR PRINTING MACHINE

BACKGROUND OF THE INVENTION

The present invention relates to a device for preventing irregular supplying of printing sheets for a printing machine to which printing sheets are supplied one at a time, in which the undesired supply of two or more printing sheets at one time is detected to suspend the sheet supply operation.

In a conventional device of this type, irregular sheet supply is detected by utilizing the fact that, where printing sheets are allowed to pass between a light emitting unit and a light receiving unit, the quantity of light which passes through two or more printing sheets stuck together is smaller than the quantity of light which passes through a single printing sheet. However, when the material or thickness of the printing sheets is changed, or when (as in multi-color printing) sheets printed once are fed to the printing machine again the quantity of light passing through the printing sheet changes. Accordingly, whenever the printing mode is changed, it is necessary to adjust the sensitivity of the light receiving unit. This adjustment is rather troublesome. As the adjustment is carried out using only the intuition of the operator, it is difficult to adjust the sensitivity accurately which may lead to erroneous operations.

An automatic printing machine is known in which a series of steps of loading a original plate on the cylinder, inking, supplying printing sheets, printing and discharging the plate are automatically carried out with a control device such as a microcomputer. If the irregular sheet supply preventing device as described above is used with the automatic printing machine, whenever the original plate is changed (and hence whenever the printing picture is changed) it is necessary to both adjust the sensitivity of the light receiving unit in order to find the most suitable positions of the light emitting unit and the light receiving unit, and to adjust the preventing device itself. These adjustments have prevented the provision of a fully automatic printing machine.

SUMMARY OF THE INVENTION

In view of the foregoing, an object of the invention is to provide a device for preventing irregular sheet supply suitable for automating a printing machine, in which the supply of two or more printing sheets is positively prevented. Furthermore, even if the quantity of light passing through a printing sheet is changed (for instance, by the change of an original plate) the sensitivity for light detection is automatically adjusted.

In accordance with this and other objects of the invention, there is provided a device for preventing irregular supplying of printing sheets for a printing machine including a detection circuit for detecting a quantity of light passing through printing sheets supplied to the printing machine. A memory circuit stores a value representing a quantity of light corresponding to one printing sheet as detected by the detection circuit with this value being stored in the momory circuit before a printing operation is started. A control circuit operatively coupled to the memory circuit automatically controls the printing machine. The control circuit causes the memory circuit to store the value corresponding to one printing sheet whenever a printing operation starts or whenever the printing mode is changed. With this construction, when a quantity of light detected by the detection circuit is less than the value stored in the memory circuit, the control circuit causes the sheet supplying operation in the printing machine to be suspended.

DESCRIPTION OF THE PREFERRED EMBODIMENTS

The invention will be described with reference to a preferred embodiment shown in the accompanying drawings.

Figure 1:
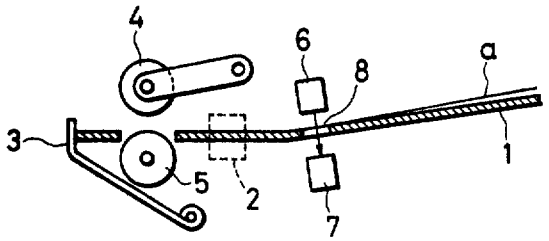
FIG. 1 is a longitudinal side view of essential components of a device for preventing irregular supplying of printing sheets for a printing machine according to the invention.

In FIG. 1, reference numeral 1 designates a feeder board for feeding a printing sheet a. A registering device 2 of a type well known in the art is provided on one side of the feeder board 1, and a front guide mechanism 3 is provided at the front end of the feeder board 1.

The front guide mechanism 3 operates as follows. In order to position the printing sheet a with respect to the transfer image on a rotating impression cylinder, the printing sheet a is stopped by the front guide mechanism 3. After the printing sheet a has been positioned, the mechanism 3 is swingably moved downward to release the printing sheet a so that the printing sheet a is inserted between the cylinders by rotation of a pair of feed rollers 4 and 5 disposed vertically. The feeder board 1 has a throughhole 8. A light emitting unit 6 and a light receiving unit 7 are disposed respectively above and below the through-hole 8, so that a line connecting these units 6 and 7 is perpendicular to the printing sheet a on the through-hole 8. The quantity of light passing through the printing sheet a is measured through the through-hole 8 by the light receiving unit 7.

Figure 2:
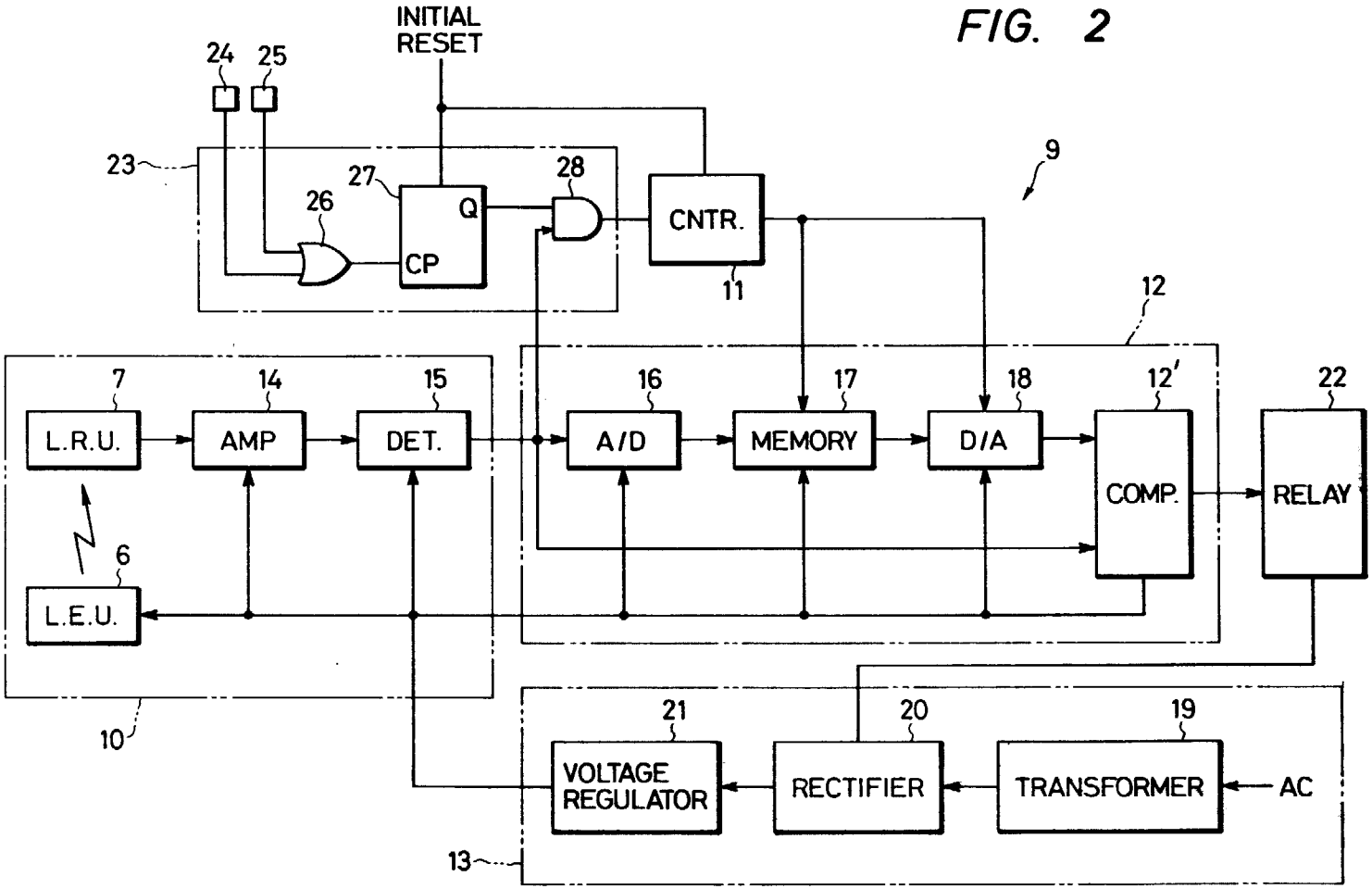
FIG. 2 is a block diagram showing an electrical circuit employed with the device in FIG. 1.

A circuit 9 for preventing irregular sheet supply according to the quantity of light measured by the light receiving unit 7, as shown in FIG. 2, includes a detection circuit 10, a comparison circuit 12, a set signal inputting circuit 23 for controlling the operation of the comparison circuit 12 in response to output signals from a control device 24 adapted to automatically control the drive of the printing machine, and a counter circuit 11. When the light receiving unit 7 detects light from the light emitting unit 6 which has passed through the printing sheet a, the light receiving unit 7 provides a pulse output signal as indicated at (B) in FIG. 3. After being amplified by an amplifier circuit 14, the output signal is converted into an analog signal having an amplitude corresponding to the quantity of light passing through the recording sheet a by a detecting circuit 15. In the comparison circuit 12, this analog signal is converted to a digital value by an A-D (analog-to-digital) converter 16, and the digital value is stored in a memory circuit 17. The content of the memory circuit 17 is subjected to analog conversion by a D-A (digital-to-analog) converter 18 and is then applied to a comparator circuit 12'.

The comparator circuit 12' compares the output signal of the detection circuit 10 at the time of sheet supply after the memory operation representing the quantity of light passing through the printing sheet a has been completed with the content of the memory circuit 17. If the value representative of the quantity of light is smaller than the stored digital value, the comparator circuit 12' operates an output relay 22 which stops the sheet feeding operation or the sheet inserting operation in which a sheet is inserted between the cylinders.

The set signal inputting circuit 23 is constructed of an OR gate 26, a J-K flip-flop 27 and an AND gate 28. Outputs from a set button 25 and a control device 24 are coupled through the OR gate 26 to the clock input of the J-K flip-flop 27. The Q output of the J-K flip-flop 27 is coupled to one input of the AND gate 28, to the other input of which is coupled to the output of the detecting circuit 15. The output of the AND gate 28 is coupled to the clock input of a counter 11. The counter 11 and the J-K flip-flop are cleared at the start of operations by an INITIAL RESET pulse.

A print start signal or a print picture changing signal is applied from the control device 24 to the set signal inputting circuit 23 to operate the counter circuit 11. When the sheet supply is started, the counter circuit 11 receives signals pulses corresponding to the sheet supply from the detecting circuit 15. As a result, the digital value outputted by the counter circuit is incremented repeatedly. When the number of pulses thus counted reaches the set value, the counter circuit 11 operates the D-A converter 18 and accordingly the comparator circuit 12'.

In order to prevent erroneous operations due to variations in the quantity of light which passes through a printing sheet of non-uniform thickness or through a printed picture in a multi-color printing operation, a predetermined number of printing sheets are fed as a result of which a minimum of the quantity of light passing through the predetermined number of printing sheets is stored. For this purposes, a value corresponding to the predetermined number of printing sheets is set in the counter circuit 11. Sometimes, in a normal printing operation, one or several printing sheets are fed to adjust the position of a picture at the start of the printing operation. In this case, a corresponding value can be set in the counter circuit 11. A correct value of the minimum quantity of light can be stored in the memory circuit irrespective of the printing speed thus improving the stability of the device. The above-described detection circuit 10, comparison circuit 12 and output relay 22 are connected to a power source circuit 13 which includes a transformer 19, a rectifier 20 and a voltage regulator circuit 21.

Figure 3:
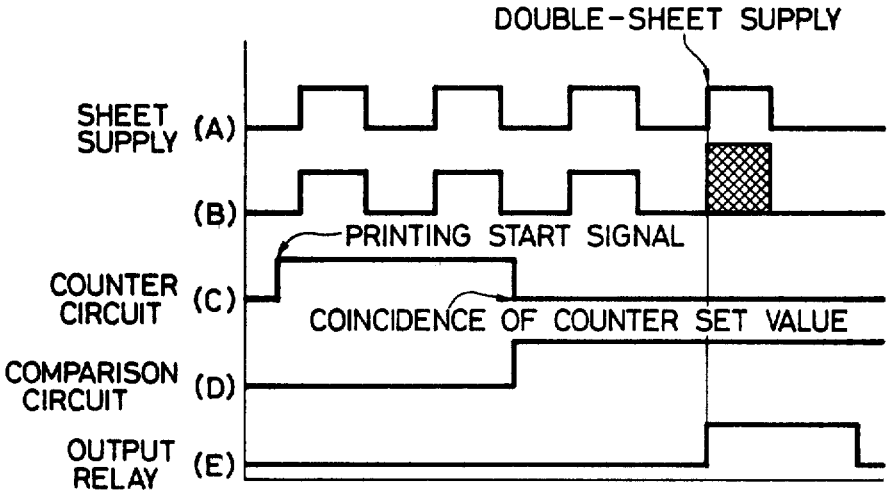
FIG. 3 is a timing diagram used for a description of the operation of the electrical circuit in FIG. 2.

The operation of the above-described circuit 9 will be described. First, the print start signal or the print picture changing signal outputted from the set button 25 or the control device 24 is applied to the set signal inputting circuit 23 as indicated by (C) in FIG. 3 in response to which the operation of the counter circuit 11 is started. Next, as the sheet supply is carried out as shown at (A) in FIG. 3, the signal indicated at (B) in FIG. 3 is inputted through the set signal inputting circuit 23 to the counter circuit 11, as well as to the comparison circuit 12. The counter circuit 11, upon receiving this signal, carries out an incrementing operation for each pulse received until the count value coincides with the value set therein. During the operation of the counter circuit 11, the minimum of the quantities of light passing through the number of sheets, which has been set in the counter circuit 11, is stored in the memory circuit 17. When the count output of the counter circuit 11 coincides with the value set therein, the comparator circuit 12' operates as indicated at (D) in FIG. 3 wherein the quantity of light passing through a printing sheet a supplied thereafter is compared with the content of the memory circuit 17. If two or more sheets stuck together are fed, the quantity of light detected by the light receiving unit 7 is decreased. The reduced quantity of light is compared with the value stored in the memory circuit. Since the quantity of light thus detected is smaller than the stored value, the output relay 22 is operated as indicated at (E) in FIG. 3 to stop the sheet feeding device or the sheet inserting mechanism and hence the printing operation.

When, after the printing operation has been accomplished, or during the printing operation, a subsequent print start signal or print picture changing signal is applied to the set signal input circuit 23 by the control device 24, the counter circuit 11 is operated again so that a new value representing the appropriate quantity of light is stored in the memory circuit 17. Thereafter, the above-described operations are carried out again. Also, the operations described above are similarly carried out when the set button 25 is again operated.

The operation of the above-described preferred embodiment is carried out under the condition that one sheet is supplied at a time. Therefore, a digital value representing the quantity of light passing through one sheet is stored in the memory circuit.

In the device for preventing irregular supplying of printing sheets for a printing machine according to the invention, a digital value representing the quantity of light passing through a single printing sheet supplied to an offset press is stored and the stored value is compared with a digital value representing the quantity of light passing through printing sheets supplied thereafter. When the latter is smaller than the former, the sheet feeding device or the sheet inserting mechanism is stopped and hence the sheet supplying operation is stopped. Furthermore, whenever the quantity of light passing through a printing sheet is changed because of differences in quantity or thickness of the printing sheet or a multi-color printing operation, the stored value is automatically corrected so that the irregular sheet supplying is thus detected with a high accuracy. Thus, in the device of the invention, unlike the conventional device, it is not necessary to manually adjust the sensitivity whenever the quantity or thickness of printing sheets or the printing mode is changed. That is, the sensitivity of the device of the invention is automatically adjusted and stabilized.

If a printing sheet is printed twice in a multi-color printing operation, the quantity of light passing therethrough will be varied by the printed picture. Even in this case, irregular sheet supply can be detected accurately. Furthermore, even if paper dust or oil contaminates the light emitting unit or the light receiving unit reducing the quantity of light, a value representing the reduced quantity of light is detected and stored. Therefore, even in such a case, irregular sheet supply is detected with a high accuracy. Thus, in all cases, irregular sheet supply is prevented.

What is claimed is:

1. A device for preventing irregular supplying of printing sheets for a printing machine comprising:

a detection circuit for detecting a quantity of light passing through printing sheets supplied to said printing machine;

a means for storing a value in a memory circuit representing a lowest quantity of light corresponding to a printing sheet detected by said detection circuit;

a counting means having a preset count manually set therein, said counting means having a clock input coupled to said output of said detector circuit for counting printing sheets, an output of said counter being coupled to an input of said memory circuit for causing said memory circuit to store the minimum of said values of said counted printing sheets; and a control circuit connected to said memory circuit for automatically controlling said printing machine, said control circuit comprising a digital-to-analog converter having a digital input coupled to an output of said memory circuit and a comparison circuit having a first input coupled to an analog output of said digital-to-analog converter and a second input coupled to an output of said detecting circuit means, said digital-to-analog converter being enabled and said storing operation of said memory circuit being disabled by said control circuit when said count of said printing sheets equals said preset count manually set in said counting means, wherein when a quantity of light subsequently detected by said detection circuit is less than said value stored in said memory circuit, said control circuit causes said sheet supplying operation to be suspended.

2. The device for preventing irregular supplying of printing sheets of claim 6 wherein said detection circuit comprises a light emitting unit, a light receiving unit disposed opposite said light emitting unit with a printing sheet path therebetween, an amplifier coupled to an output of said light receiving unit and detecting circuit means for converting an output of said amplifier to an analog signal having an amplitude corresponding to a quantity of light received by said light receiving unit.

3. The device for preventing irregular supplying of printing sheets of claim 2 wherein said control circuit comprises a digital-to-analog converter having a digital input coupled to an output of said memory circuit, a comparison circuit having a first input coupled to an analog output of said digital-to-analog converter and a second input coupled to an output of said detecting circuit means, and relay means operating in response to an output of said comparison circuit for inhibiting the supply of printing sheets.

4. The device for preventing irregular supplying of printing sheets of claim 3 wherein said control circuit further comprises a counter set to said predetermined number having a clock input coupled to said output of said detecting circuit means for counting printing sheets, a first output of said counter being coupled to an input of said memory circuit for causing said memory circuit to store said value, and a second output of said counter being coupled to said digital-to-analog converter for enabling said stored value be to compared to said output of said detecting circuit means when said count of said printing sheets equals said predetermined number set in said counter circuit.

5. A device for preventing irregular supplying of printing sheets for a printing machine comprising:

a light emitting unit;

a light receiving unit disposed opposite said light emitting unit with a path for printing sheets therebetween;

amplifier means coupled to an output of said light receiving units;

detecting circuit means coupled to an output of said amplifier means for producing an analog signal representative of a quantity of light received by said light receiving unit;

an analog-to-digital converter having an analog input coupled to an output of said detecting circuit means;

a digital memory having an input coupled to an output of said analog-to-digital converter;

a digital-to-analog converter having a digital input coupled to an output of said memory;

an OR gate having first and second inputs coupled, respectively, to a set button and an output of a control device;

a J-K flip-flop having a clock input coupled to an output of said OR gate;

an AND gate having a first input coupled to a Q output of said J-K flip-flop and a second input coupled to said output of said detecting circuit means;

a counter receiving an output of said AND gate and producing an output utilized as respective inputs to said digital memory and said digital-to-analog converter;

a comparison circuit having a first input coupled to an analog output of said digital-to-analog converter and a second input coupled to said output of said detecting circuit means; and a relay circuit having a control input coupled to an output of said comparison circuit for inhibiting the supply of printing sheets.

* * * * *